US008757740B2

(12) United States Patent
Bühlmeyer et al.

(10) Patent No.: US 8,757,740 B2
(45) Date of Patent: Jun. 24, 2014

(54) PLATFORM FOR A DISH WASHING MACHINE

(75) Inventors: Alexander Bühlmeyer, Bopfingen (DE); Werner Haltmayer, Dinkelsbühl (DE); Cengiz Kücük, Syrgenstein (DE); Michael Georg Rosenbauer, Reimlingen (DE); Bernd Schessl, Dillingen (DE); Manfred Seeβle, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 679 days.

(21) Appl. No.: 11/990,411

(22) PCT Filed: Aug. 10, 2006

(86) PCT No.: PCT/EP2006/065210

§ 371 (c)(1),
(2), (4) Date: Feb. 13, 2008

(87) PCT Pub. No.: WO2007/020226

PCT Pub. Date: Feb. 22, 2007

(65) Prior Publication Data

US 2009/0102336 A1 Apr. 23, 2009

(30) Foreign Application Priority Data

Aug. 19, 2005 (DE) ..... 10 2005 039 375

(51) Int. Cl.
*A47B 77/06* (2006.01)

(52) U.S. Cl.
USPC ..... 312/228; 312/257.1

(58) Field of Classification Search
USPC ..... 312/257.1, 263, 228, 265.5; 134/57 D, 134/58 D, 56 D
See application file for complete search history.

(56) References Cited

U.S. PATENT DOCUMENTS 5,299,586 A * 4/1994 Jordan et al. ..... 134/111
5,368,379 A * 11/1994 Wrangberth ..... 312/228

(Continued)

FOREIGN PATENT DOCUMENTS

DE 197 56 516 6/1999
EP 0 243 631 11/1987

(Continued)

OTHER PUBLICATIONS

International Search Repoprt PCT/EP2006/065210.

*Primary Examiner* — Daniel Rohrhoff
(74) *Attorney, Agent, or Firm* — James E. Howard; Andre Pallapies

(57) ABSTRACT

A dish washing machine includes a tub, which is open at the front and at the bottom, is at least partially made of non-rusting metal and which has walls, a separate housing, and a mounting floor at least partially made of plastic. The tub is placed on the mounting floor to form a washing compartment, and the washing compartment wall is formed from the mounting floor. According to the invention, the visible surface inside the washing compartment of the washing compartment wall formed by the mounting floor has, at least in part, a different appearance than that of the plastic of the remaining mounting floor. The different appearance is obtained by an insert made of stainless steel on the mounting floor. A stainless steel surface that, to the user, appears highly effective can thus be obtained in the entire interior of the washing container even in the case of a platform for a dish washing machine having a tub made of stainless steel that is placed on a plastic mounting floor.

25 Claims, 7 Drawing Sheets

(56) References Cited

U.S. PATENT DOCUMENTS

| | | | | |
|---|---|---|---|---|
| 6,241,331 | B1 * | 6/2001 | Kammerl et al. | 312/265.5 |
| 6,622,740 | B1 * | 9/2003 | Durazzani | 134/201 |
| 2004/0003832 | A1 * | 1/2004 | Jerg et al. | 134/93 |
| 2005/0017609 | A1 * | 1/2005 | Kucuk et al. | 312/228 |

FOREIGN PATENT DOCUMENTS

| | | | |
|---|---|---|---|
| EP | 0 243 632 | | 11/1987 |
| EP | 0452287 | A1 | 10/1991 |
| EP | 0 556 787 | | 8/1993 |
| JP | 2004-89416 | A | 3/2004 |

* cited by examiner

PLATFORM FOR A DISH WASHING MACHINE

The invention relates to a dishwashing machine, comprising a tub which is open at the front and at the bottom and consists at least partly made of non-rusting metal and which has walls, a separate housing, a mounting floor consisting at least partly of plastic, with the tub being arranged on the mounting floor to form a washing compartment and the washing compartment floor wall being formed from the mounting floor. The invention further relates to a method of production for such a dishwasher.

BACKGROUND OF THE INVENTION

The basic mechanical design of a dishwasher, especially a household dishwasher, is referred to as a platform. The platform of a dishwasher essentially comprises the washing compartment and the way in which the washing compartment is supported on the floor, e.g. by a mounting floor made of metal or plastic. Under some circumstances the platform, in addition to the aforementioned components, is also taken to mean the installation of or the option of installing functional components, e.g. pumps, heating, electrical or hydraulic plug-in connections, filter or water softening device and/or the housing.

The following platform is known from the prior art: A washing compartment is placed on a mounting floor made of plastic. The washing compartment with two sidewalls, a rear wall, a lower wall and an upper wall (only open to the front) is made entirely of stainless steel and is generally produced by means of bending and joining processes, e.g. welding, in general from a number of stainless steel plates. The mounting floor is therefore a tray open at the top, which for example is presented in applicant's EP 0 243 632 A2 and EP 0 243 631 B1.

Attached to the washing compartment made of stainless steel and/or to frame parts preferably made of metal, the housing (preferably embodied as coated metal plates) are normally attached to the dishwasher essentially at specific points or with small contact surfaces, for example by screw or clip connections. The housing thus consists of at least one separate outer wall. The washing compartment made of stainless steel is thus a separate component independent of the housing and not integrated into a housing typically made of plastic, i.e. especially connected to each other over a large surface area. The visible stainless steel surface in the washing compartment is thus not merely a coating or cladding of the housing, made of plastic for example, with stainless steel or a stainless steel plate overmolded during the injection molding of the plastic housing as in the EP 0 556 787 B2. To this extent housing and washing compartment are independent of each other. This constructive layout between housing and washing compartment also applies to the applicant's DE 101 56 423 A1 and EP 0 452 287 B1 as the prior art mentioned further below.

Known from EP 0 556 787 B2 is a platform with an upper part, containing two side walls a lower wall and an upper wall, in which the housing and the part of the washing compartment formed by the upper section form a unit and are double walled, i.e. made in one piece from plastic and are placed on a mounting floor as a base, likewise made of plastic. This invention therefore involves a platform concept other than that described above, which especially because of the use of plastic and the integrated connection between housing and washing compartment as a twin-wall plastic part in the upper section, differs from the above-mentioned prior art. For optical refinement at least a part of the visible surface of the floor of the washing chamber, which is embodied in one piece with the base made of plastic, can have a metallic surface.

In a development of the first platform described above (not EP 0 556 787 B2) a washing compartment is known from EP 0 452 287 B1 which merely features two side walls, a rear wall and an upper wall made of stainless steel (tub) and the lower wall of the washing compartment is formed by the mounting floor made of plastic, i.e. the mounting floor is thus not a tray open at the top as in EP 0 243 632 A2 and EP 0 243 631 B1, but a box essentially enclosed on all sides.

A platform with a stainless steel washing compartment made from two sidewalls, a rear wall and an upper wall is likewise known from the applicant's DE 101 56 423 A1. The lower wall of the washing compartment, is likewise formed from the mounting floor made of plastic.

This platform concept, especially known from the applicant's EP 0 452-287 B1 and DE 101 56 423 A1, in which the plastic mounting floor forms the lower wall of the washing compartment and feature a special housing, are more cost effective and simple to produce. The disadvantage of these two last-mentioned platforms is however, that in the inside of the washing compartment, i.e. after the assembly of the dishwasher, it is essentially plastic and not stainless steel which is visible to the end consumer on the surface of the washing compartment lower wall. The end consumer sees the use of stainless steel in the washing compartment as a particular quality feature, so that this platform concept thus appears subjectively to the end consumer or user of the dishwasher to be of lower quality.

BRIEF SUMMARY OF THE INVENTION

The object of the present invention is thus to provide a dishwasher with a platform, which on the one hand is cost-effective and simple to produce and on the other hand appears to the user of the dishwasher to be a high-quality product. The object is also to specify a method for producing a dishwasher of this type.

This object is achieved by an inventive dishwasher and an inventive method for producing a dishwasher as described and claimed herein. Advantageous embodiments are also disclosed.

The inventive dishwasher comprises a tub which is open at the front and at the bottom and is at least partly made of a non-rusting metal and which has walls, a separate housing, a mounting floor at least partly consisting of plastic, with the tub being arranged on the mounting floor to form a washing compartment and the washing compartment lower wall being formed from the mounting floor, with the visible surface in the inside of the washing compartment of the dishwasher compartment lower wall formed by the mounting floor having at least partly a different appearance from the plastic of the rest of the mounting floor. This means that advantageously a different optical impression of the washing compartment can be created for the user, so that an adaptation to different price classes, e.g. economy-class, midrange and premium-class dishwashers, is possible.

In a preferred embodiment the visible surface in the inside of the washing compartment of the washing compartment lower wall formed by the mounting floor has at least partly a metallic appearance, especially the appearance of stainless steel, or there is at least partly a surface made of non-rusting metal, especially made of stainless steel present. This can be used to create the impression for the user of a washing compartment made entirely of stainless steel which represents a particular hallmark of quality for the consumer. The metallic look can also be created by materials other than metal, e.g. plastic which have an appearance of metal. This can also involve plastic with effect pigments which exhibit a luster or color effect, e.g. luster, gold luster, color change or interference effects.

In a further embodiment the visible surface in the inside of the washing compartment of the washing compartment lower wall formed by the mounting floor is at least partly a different color from that of the plastic of the rest of the mounting floor. This means that new previously unknown aesthetic effects of the washing compartment can be created for the consumer. The other colors can be red, green, blue or yellow for example and can be obtained by appropriately colored inserts made from plastic.

Preferably the visible surface of the washing compartment lower wall formed by the mounting floor in the inside of the washing compartment can feature at least partly a surface structure, e.g. a honeycombed, circle-pattern, corrugated or rectangle-pattern surface. This surface structure gives the user a particular enhanced impression of the quality of the dishwasher and can have a sound-deadening effect, i.e. can thus also have a technical effect.

In a supplementary embodiment the visible surface of the washing compartment lower wall formed by the mounting floor in the inside of the washing compartment is at least partly formed from non-rusting metal foil, especially stainless metal foil, e.g. made of chrome-nickel steel. This type of metal foil is especially inexpensive and light and is joined to the plastic of the mounting floor by overmolding.

Expediently the visible surface of the washing compartment lower wall formed by the mounting floor in the inside of the washing compartment is formed at least partly from a non-rusting metal sheet, especially a stainless steel sheet, e.g. made from chrome-nickel steel.

As a result of its relatively large thickness the metal sheet has the advantage of being very capable of resisting mechanical stresses.

Advantageously the visible surface of the washing compartment lower wall formed by the mounting floor in the inside of the washing compartment is at least partly embodied from an insert as a preferably pre-formed non-rusting metal sheet, especially a stainless steel sheet, e.g. made from chrome-nickel steel. An insert under some circumstances only needs to be laid on the mounting floor, so that the installation costs are very low.

In a further embodiment the insert is laid onto the washing compartment lower wall made of plastic with or without a seal to the plastic washing compartment lower wall of the mounting floor or the insert part is spaced, especially by the formation of a gap, from the plastic washing compartment lower wall, for example with the aid of distance pieces.

In an additional embodiment a closed plastic washing compartment lower wall is present. This means that no sealing means is required between the additional parts to be included, e.g. metal foil, metal sheet or insert part or layers and the washing compartment lower wall of the mounting floor, because the mounting floor itself, because of the absence of openings, is watertight regardless of additional parts.

In a further embodiment the visible surface in the inside of the washing compartment of the washing compartment lower wall formed by the mounting floor is at least partly embodied from non-rusting metal sheet or insert, especially made of stainless steel, e.g. chrome-nickel steel, with the metal sheet being sealed relative to the plastic of the washing compartment lower wall, e.g. by an adhesion point or area or through a gapless joint between the metal sheet or insert part, for example manufactured by back molding.

Preferably the insert is connected by at least one latching element with the plastic washing compartment lower wall.

Expediently there is a washing compartment lower wall made of plastic with at least one opening.

As an addition, instead of a metal foil, a metal plate or an insert, a geometrically identical part is used which however consists of a material other than metal, especially plastic, and preferably is of a color which differs from that of the plastic of the rest of the mounting floor. Thus, using the same mounting floor, both a dishwasher with washing compartment floor made of plastic on the surface can be produced for lower-price classes and also a dishwasher with a washing compartment floor made of stainless steel on the surface can be produced for higher-price classes. This means that a flexible platform concept is provided since it allows suitable washing compartments to be created for all price classes.

In a further embodiment the mounting floor is statically self-supporting, i.e. statically independent of metal foil and/or metal sheet and/or insert on the washing compartment lower wall. This means that the mounting floor can also be used for variants without additional parts.

In a supplementary embodiment the arrangements of metal foil, metal sheet and/or insert and/or coatings are combined with each other on the washing compartment lower wall. This means that a different surface can be created on the surface of the washing compartment lower wall which leaves the users with a marketing-relevant visual impression.

In a further embodiment the tub made of non-rusting metal, especially stainless steel, is not a plastic covering of a housing. This means that there is no constructive embodiment of housing, washing compartment and mounting floor which is described in EP 0 556 787 B2. A separate housing is taken to mean a arrangement of housing, washing compartment and mounting floor, which does not correspond to an arrangement as in EP 0 556 787 B2.

Preferably the housing is arranged apart from or separated from the tub and/or mounting floor.

Expediently the separate housing is not connected over a wide area to the tub and/or mounting floor, i.e. the housing represents an independent component in relation to the tub.

In a further embodiment the housing is connected at specific points or by small contact surfaces with attachment means, for example through screwed, riveted or locking connections, to a frame and/or the washing compartment and/or the mounting floor.

In a further embodiment the separate housing consists of at least one wall, made from coated sheet metal for example, and comprises preferably two housing side walls and a upper housing wall.

In an additional embodiment the walls are arranged at a short distance, e.g. ranging from 0.1 to 7 cm, from the walls of the tub and/or the walls of the mounting floor.

Expediently the walls of the tub are a left-hand washing compartment wall, a right-hand washing compartment wall, a rear washing compartment wall and an upper washing compartment wall.

In a further embodiment the tub consists of stainless steel, for example chrome-nickel steel or non-rusting metal, e.g. chrome steel. A tub consisting entirely of stainless steel gives the consumer a particularly great impression of quality. Chrome-steel is a lower-priced material than chrome-nickel steel, but has the disadvantage that corrosion can arise after long-term contact with water or moisture. In the inner chamber of a washing compartment however there is no such long-term possibility of contact with water, only for example behind seals. Chrome steel is therefore considered to be a non-rusting metal.

In a further embodiment the mounting floor is embodied as a shell structure with a washing compartment lower wall, a rear wall, two side walls, a lower wall and a front wall.

In a further variation the lower wall of the mounting floor consists of a material other than plastic, e.g. metal, and is attached via connection means, e.g. a screw- and/or clamp connection, to the rest of the mounting floor (16).

Preferably the walls of the mounting floor feature openings for repair and maintenance purposes.

Expediently the mounting floor is embodied as a frame structure.

In a further embodiment the mounting floor is a multipart element. The mounting floor can thus be combined from a number of parts which can consist of different materials.

In an advantageous embodiment the plastic of the mounting floor is a thermoplastic e.g. polypropylene (PP).

Expediently the invention relates to a household dishwasher, i.e. not to a commercial dishwasher for example.

Normally this involves a built-in, solo or built-under dishwasher or a fully-integrated dishwasher, but not however a compact or tabletop dishwasher. Built-in, solo or built-under dishwashers or fully-integrated dishwashers (approximate dimensions: Height 82 to 88 cm, width 60 cm or 45 cm, depth 57 cm or 50 cm) have much greater dimensions compared to so-called compact or tabletop dishwashers (approximate dimensions for example: Height: 45 cm, width: 55 cm, depth: 46 cm). Solo dishwashers are taken to mean freestanding dishwashers not intended for building into a fitted kitchen.

In an inventive method for producing a dishwasher, comprising a tub open to the front and to the bottom and consisting at least partly consisting of non-rusting metal with walls, a separate housing, a mounting floor consisting at least partly of plastic, with the tub being arranged on the mounting floor to form a washing compartment and a washing compartment lower wall being formed by the mounting floor, a material other than the plastic of the rest of the mounting floor is at least partly applied and/or added to the visible surface in the inside of the washing compartment of the washing compartment lower wall formed from the mounting floor.

Preferably the other material is a non-rusting metal, e.g. chrome-nickel steel or chrome steel and a metal foil, a metal sheet or an insert is involved which is joined to the plastic of the mounting floor by overmolding, gluing, laying onto or latching with the plastic of the mounting floor.

In a supplementary embodiment a surface structure, e.g. at least partly a honeycombed, circle-pattern, corrugated or rectangle-pattern surface, is applied to the metal foil, the non-rusting metal sheet or the insert, for example by changing its shape, e.g. deep-drawing, bending or extrusion or cutting production methods, e.g. milling or grinding, or removal, e.g. thermal, chemical or electrochemical removal, or laser separation.

Expediently the other material is applied to the washing compartment lower wall by coating.

In a supplementary embodiment the tub is preferably inserted into a slot-shaped recess on the mounting floor and connected to the mounting floor using an attachment method, for example screwing, gluing or clamping.

In a further embodiment an inventive dishwasher with the features described above can be produced using the above method.

Non-rusting metal is taken to mean a metal which, on continuous contact with water or moisture, exhibits corrosion formation but with no continuous contact with water or moisture does not exhibit any corrosion formation. For example chrome-nickel steel as stainless steel does not exhibit any corrosion formation even when constantly in contact with moisture or water. For example chrome steel as a non-rusting metal, which costs less than chrome-nickel steel, exhibits corrosion during constant contact with water or moisture but does not exhibit corrosion when not in constant contact with water or moisture. Therefore for example corrosion occurs with a tub made of chrome steel in gaps or behind seals which constantly contain moisture or water. There is no constant contact with water or moisture in the inside of a washing compartment, so that a washing compartment made from chrome steel does not exhibit any corrosion in its interior. Stainless steel is a subset of the non-rusting metals, so that non-rusting metal is also understood to include stainless steel.

BRIEF DESCRIPTION OF THE DRAWINGS

The invention will be explained below using examples which refer to drawings. The figures show.

DETAILED DESCRIPTION OF EXEMPLARY EMBODIMENTS OF THE PRESENT INVENTION

Figure 1:
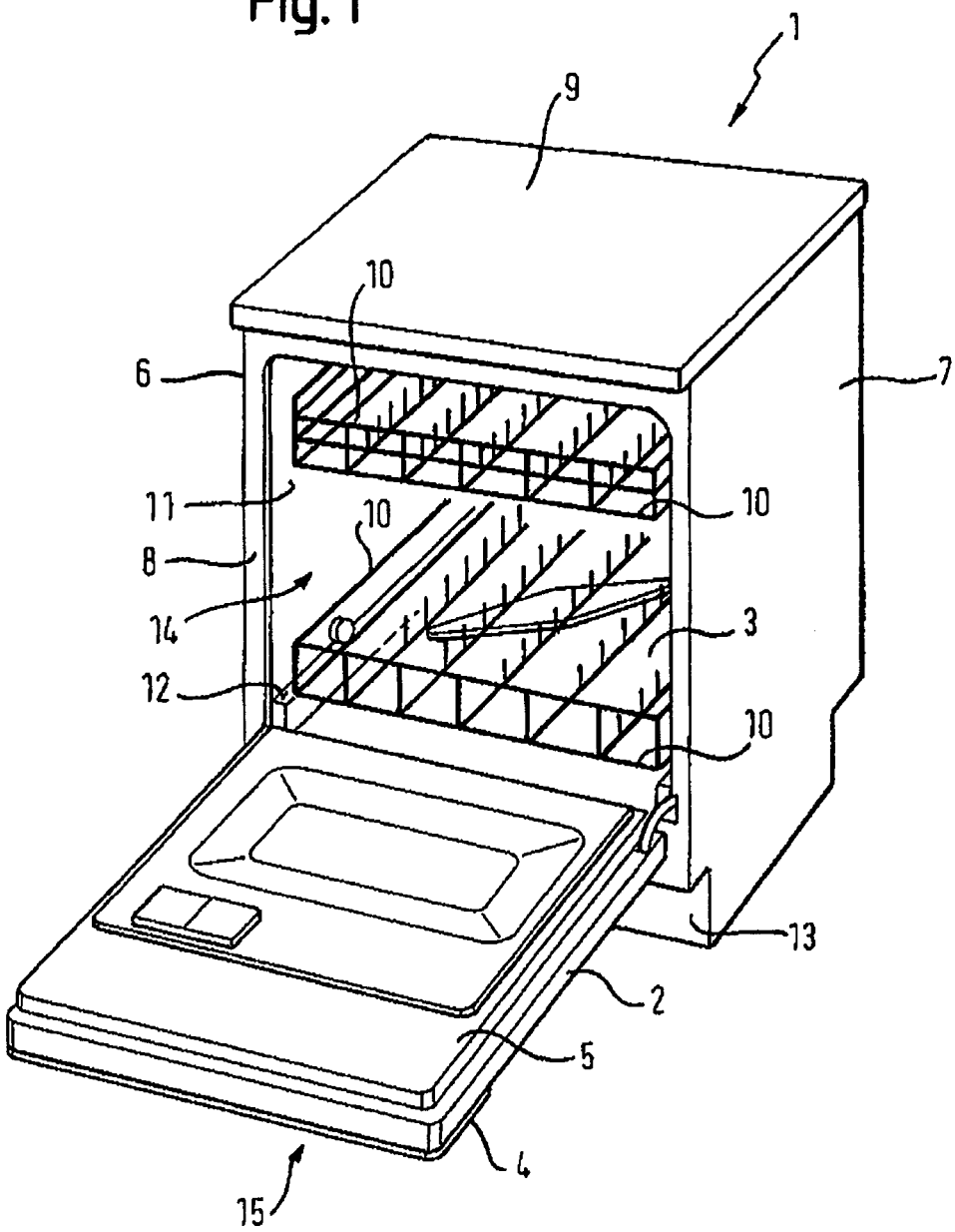
FIG. 1 a perspective view of an inventive dishwasher.

FIG. 1 shows a perspective view of an inventive dishwasher 1. The dishwasher 1 has a door 15 able to be hinged around a horizontal axis for opening and closing the washing compartment 14, with an upper and a lower basket 10 for accommodating items to be washed e.g. household dishes. The lower basket moves on rollers on an appropriately formed roller track 12. The door 15 is constructed from an inner section 5 made from a shaped steel sheet and an outer door 2 arranged at a distance from the inner door 5 as an outer panel or housing. An additional decor panel for matching the kitchen decor can be attached to the outer door with a built-in or built-under dishwasher for example. On the upper part of the outer door 2 there is a control panel 4 for operating the dishwasher 1. For the outer panels of the dishwasher 1 a left-hand side housing wall 6, a right-hand side housing wall 7 and an upper housing wall 9 are arranged around the washing compartment 14 and around the mounting floor 16 (not shown) below the washing compartment 14. Between the walls 11, 17, 18 (partly not shown) of the washing compartment 14 and the housing walls 6, 7, 9, made of coated sheet metal parts for example, there is a small space, e.g. ranging from 0.1 to 12 cm. Between the housing walls 6, 7, 9 and the walls 11, 17, 18 (partly not shown) of the washing compartment 14 a single-part or multi-part front panel 8 is attached to the opening of the washing compartment 14. The housing walls 6, 7, 9 are attached to the washing compartment 14 or tub 40 and/or supporting frame parts, especially made of metal (not shown), via attachment means, e.g. screws. There is thus a separate housing from the washing compartment 14, i.e. the walls of the washing compartment 14 are not connected over a large area with the housing and the housing walls 6, 7, 9 are at a slight distance from the washing compartment 14.

Figure 2:
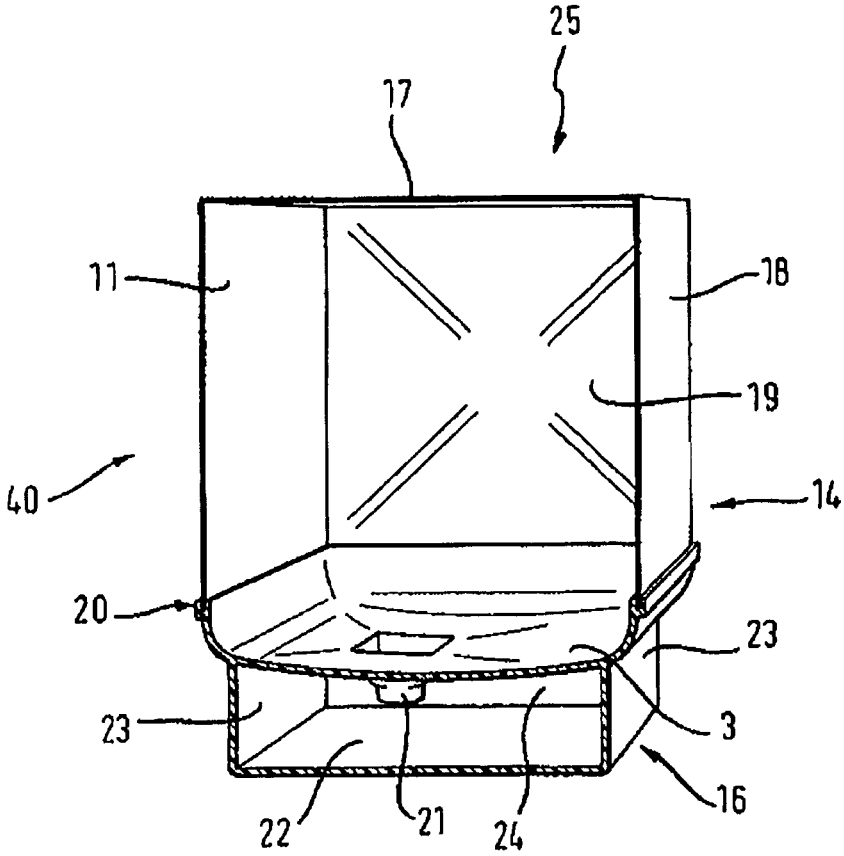
FIG. 2 a perspective view of a platform (mounting floor and washing compartment) of an inventive dishwasher, FIG. 3 a longitudinal cross section through an upper wall of a mounting floor as a closed variant, FIG. 4 a longitudinal cross section through one half of an upper wall of a mounting floor as a closed variant in a further embodiment, FIG. 5 a longitudinal cross section through one half of an upper wall of a mounting floor as a closed variant in a further embodiment, FIG. 6 a longitudinal cross section through one half of an upper wall of a mounting floor as a closed variant in a further embodiment, FIG. 7 a longitudinal cross section through one half of an upper wall of a mounting floor as a closed variant in a further embodiment, FIG. 8 a longitudinal cross section through one half of an upper wall of a mounting floor as an open variant, FIG. 9 a longitudinal cross section through one half of an upper wall of a mounting floor as an open variant in a further embodiment and FIG. 10 a longitudinal cross section through one half of an upper wall of a mounting floor as an open variant in a further embodiment.

A part of the washing compartment 14 as a tub 40 open at the front and to the bottom formed from a left-hand washing compartment wall 11, a right-hand washing compartment wall 18 (not shown), a rear washing compartment wall 19 (not shown) an upper washing compartment wall 17 (not shown) each embodied by stainless steel plates connected together by a joining method, e.g. welding, (see FIG. 2). The washing compartment lower wall 3 is part of the mounting floor (not shown). In order to also obtain a metallic appearance in the floor area of the washing compartment 14, especially a stainless steel surface, molded into the mounting floor in the visible area is an insert made from non-rusting metal or a stainless steel insert e.g. a stainless steel sheet formed by deep drawing. The options available for this are explained below by further examples.

FIG. 2 shows a perspective view of a platform 25 (mounting floor 16 and tub 40 of the washing compartment 14) of an inventive dishwasher 1. The lower wall 3 of the washing compartment 14 is formed by the plastic mounting floor 16. The mounting floor 16 is preferably produced at low cost by injection molding from a thermoplastic, e.g. polypropylene (PP). The left-hand washing compartment side wall 11, the right-hand washing compartment side wall 18, the upper wall of the washing compartment 17 and the rear wall of the washing compartment 19 consist of non-rusting metal, e.g. chrome steel or stainless steel, e.g. chrome-nickel steel, but at least one wall 11, 17, 18, 19 of the tub 40 can also consist of a material other than stainless steel, for example the top wall of the washing compartment 17 can be made of plastic. This typically involves shaped stainless steel sheets which have been connected to each other by a joining method, e.g. welding. On the upper edge of the mounting floor 16 is embodied a slot-shaped recess 20 in which the walls 11, 18, 19 are inserted for connection, for example by screwing, gluing or with clamping means, to the mounting floor 16. Other connection types, e.g. without slot-shaped mounting, can be undertaken. Fitted to the outside of the stainless steel walls 11, 17, 18, 19 of the tub 40 open to the front and to the bottom is sound insulation, made from bitumen for example.

The mounting floor 16 has an upper wall 3, which forms the washing compartment floor 3, a rear wall 24, two side walls 23, a lower wall 22 and a front wall (not shown). A drain sump is embodied in the washing compartment lower wall 3. The walls 22, 23, 24 of the mounting floor 16 can also feature smaller and larger openings, e.g. for repair or maintenance purposes. With larger openings the mounting floor 16 can thus have more of a frame structure than a shell structure. Present in the mounting floor 16 are preferably mounting and attachment means for functional components (not shown), e.g. pump, heating, electrical or hydraulic plug-in connections, filters or water softening equipment. The mounting floor 16 can also be made up of different individual parts, which under some circumstances also consist of a material other than plastic, e.g. metal. The lower wall 22 could for example be embodied as a steel part, which is attached for example by connection means, e.g. a screw and/or clamp connection, to the rest of the mounting floor 16 (not shown).

The surface of the washing compartment lower wall 3 visible in the interior of the washing compartment 14 has at least partly a different appearance from the rest of the mounting floor 16 consisting of plastic or the plastic part of the mounting floor 16, which is colored gray for example. Preferably the different appearance corresponds to the appearance of the walls 11, 17, 18, 19 made of stainless steel. In addition a different surface structure of the visible surface of the washing compartment lower wall 3 compared to the walls 11, 17, 18, 19 made of stainless steel can be selected, for example a honeycomb, circle-pattern (adjoining circles), corrugated or rectangle-pattern surface. Furthermore a different color can also be selected from that of the stainless steel walls 11, 17, 18, 19 and the mounting floor 16, e.g. green or yellow. In this way the impression of a very high-quality washing compartment 14 can be imparted to the user of the dishwasher.

Subsequent FIGS. 3 to 10 show different exemplary embodiments for creating the different appearance of the surface of washing compartment lower wall 3. Basically a distinction is made between a variant of a closed mounting floor 16 in FIG. 3 to 7 and an open mounting floor 16 in the FIG. 8 to 10. In the closed mounting floor 16 variant the plastic washing compartment lower wall 3 of the mounting floor 16 has no openings 26, i.e. is closed as shown in FIG. 2. This contrasts with the open mounting floor 16 variant, which has openings 26 in the plastic washing compartment lower wall 3 of the mounting floor 16.

Figure 3:
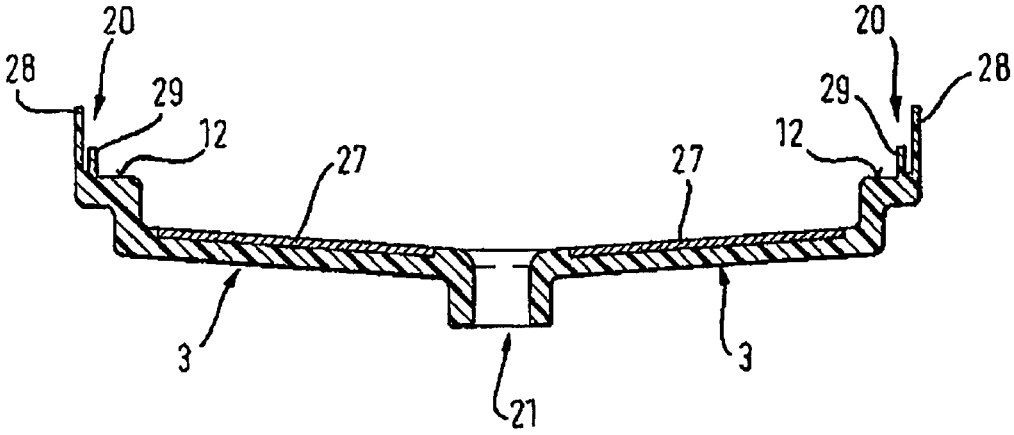

FIG. 3 shows a longitudinal cross section through an upper wall 3 of a mounting floor 16 as a closed variant. Incorporated into the washing compartment lower wall 3 is a non-rusting metal foil 27, especially a stainless steel metal foil 27, made of chrome-nickel steel for example. To this end the metal foil 27 is inserted before the injection molding of the mounting floor 16 made of thermoplastic before the melted and homogenized plastic is introduced into the tool and this joins the metal foil 27 through back molding to the mounting floor 16. The metal foil 27 can also be arranged over a larger area or over the entire area of the visible part of the washing compartment lower wall 3, e.g. up to the roller track 12 (not shown). Also to be seen in the longitudinal cross section in FIG. 3 are the drain sump 21, the roller track 12 for the lower basket 10 (not shown) and the outer slot wall 28 and the inner slot wall 29 for the slot shaped mount 20.

In subsequent FIGS. 4 to 10, in order to simplify the figure, only the right-hand part of the washing compartment wall 3 is shown, in a section similar to that shown in FIG. 3.

Figure 4:
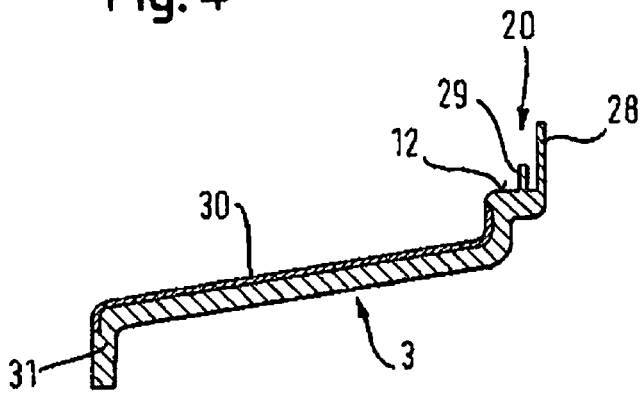

FIG. 4 shows a longitudinal cross section through one half of an upper wall 3 of a mounting floor 16 as a closed variant in a further embodiment. A pre-formed non-rusting metal sheet 30, especially a stainless steel sheet e.g. made of chrome-nickel steel, is inserted into the washing compartment lower wall 3. To this end the metal sheet 30 is inserted into the tool before injection molding and subsequently back molded with plastic. This produces a fluid-tight join between the metal sheet 30 and the remaining plastic part of the washing compartment lower wall 3 of the mounting floor 16. The left-hand end in FIG. 4 corresponds to the area 31 of the drain sump 21.

Figure 5:
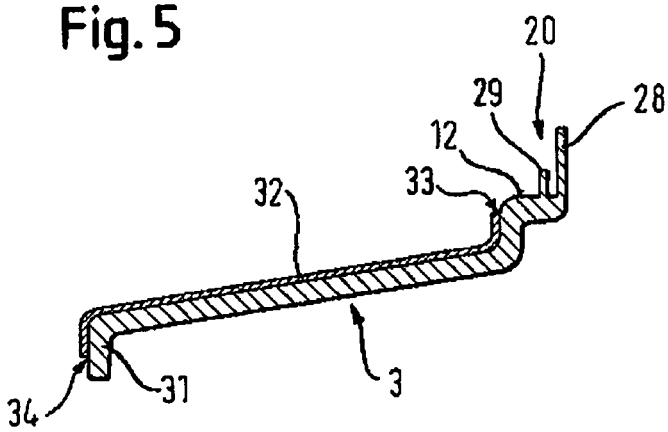

FIG. 5 shows a longitudinal cross section through one half of an upper wall 3 of a mounting floor 16 as a closed variant in a further embodiment with an insert 32 as a pre-formed non-rusting metal sheet 32, especially a stainless steel sheet 32, made of chrome-nickel steel for example. The insert 32 is not back molded, but is laid onto the plastic surface of washing compartment lower wall 3. Under some circumstances there is preferably a point fixing of the insert 32 to the washing compartment lower wall 3. This means that there is not a fluid-tight join between the insert 32 and the washing compartment lower wall 3, so that rinsing water can penetrate for example at the penetration point 33 between the insert 32 and the surface of the plastic part of the washing compartment lower wall 3. Rinsing water that has penetrated can however flow out at the exit point 34 into the drain sump 21, i.e. in the area 31 of the drain sump 21. Because of the closed variant of the mounting floor 16 this means that the washing compartment 14 is still fluid-tight.

Figure 6:
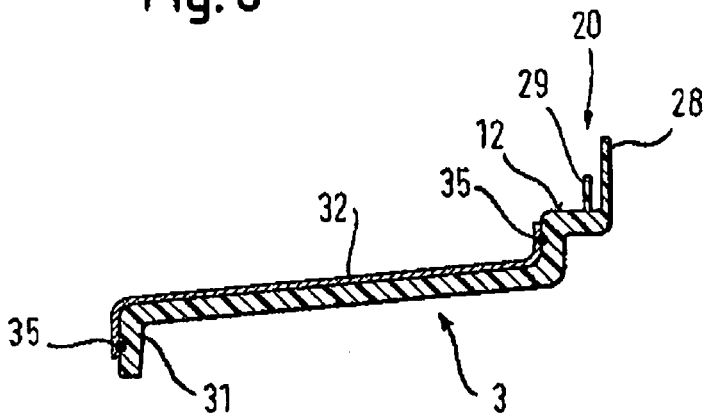

FIG. 6 shows a longitudinal cross section through one half of an upper wall 3 of a mounting floor 16 as a closed variant in a further embodiment with a sealed insert 32 as a preformed non-rusting metal sheet 32, especially a stainless steel sheet 32, made of chrome-nickel steel for example. In a similar manner to the embodiment depicted in FIG. 5, the insert 32 is laid on the surface of the washing compartment lower floor 3. However sealing elements 35 are present between the insert 32 and the surface of the plastic part of the washing compartment lower wall 3, so that no rinsing water can penetrate between the insert and the surface of the washing compartment lower wall 3. The sealing element 35 in the area 31 of the drain sump 21 is facultative.

Figure 7:
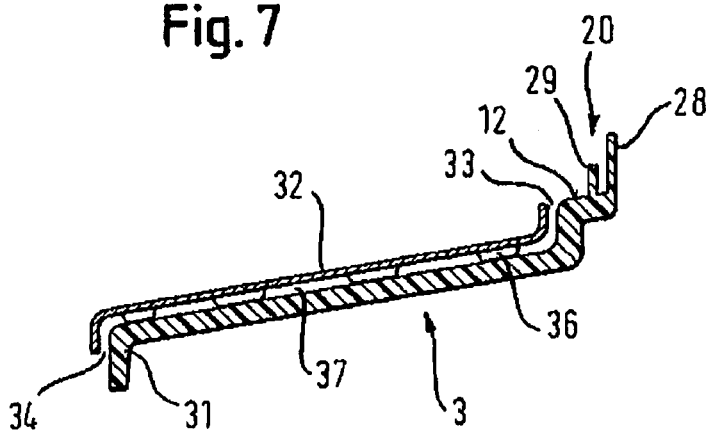

FIG. 7 shows a longitudinal cross section through one half of an upper wall 3 of a mounting floor 16 as a closed variant in a further embodiment with a spaced insert 32 as a preformed non-rusting metal plate 32, especially a stainless-steel plate 32, made of chrome-nickel steel for example. With the aid of distance pieces 36, e.g. in the form of embossed areas on the underside of the insert 32 or on the upper side of the washing compartment lower wall 3, a gap 37 is created between the insert 32 and the upper side of the plastic part of the washing compartment lower wall 3. This allows rinsing water to flow into this gap 37 at the penetration point and to flow out into the drain sump 21 at the exit point 34.

Figure 8:
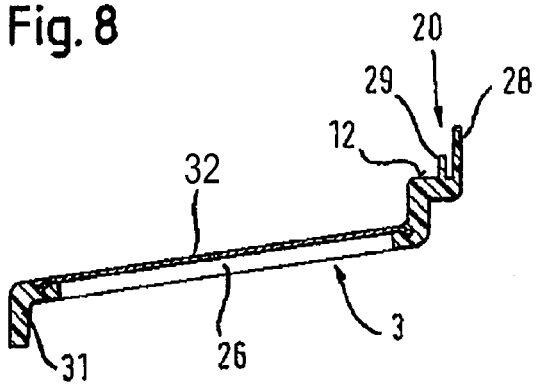
Figure 9:
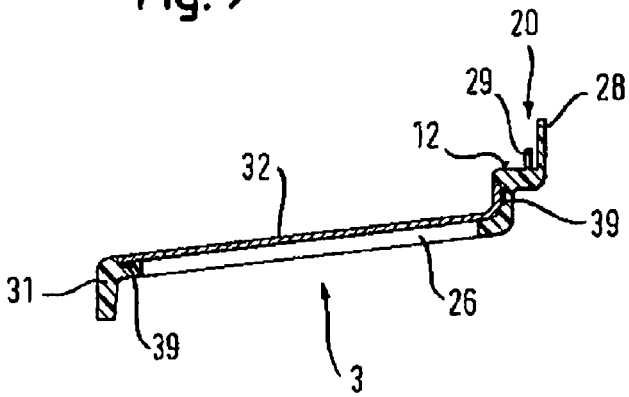
Figure 10:
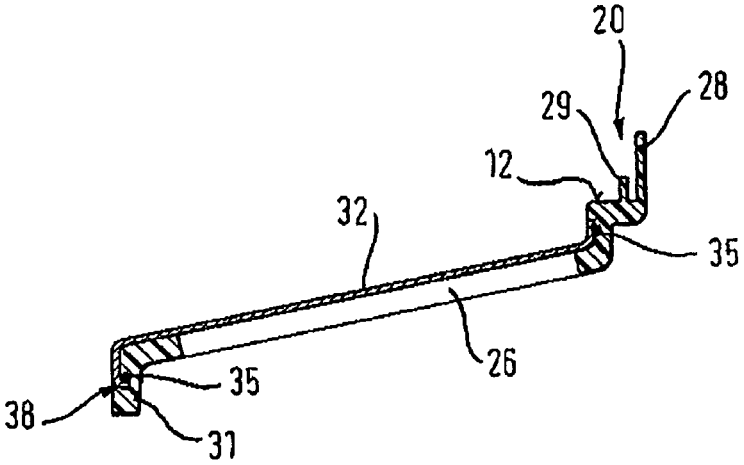

The open variant of the mounting floor 16 is shown in FIG. 8 to 10. In this variant of the mounting floor 16 there is an opening 26 in the plastic part of the washing compartment lower wall 3, whereby the connection point between insert 32 and mounting floor 16 must be fluid-tight. The insert 32 can, but does not have to, make a contribution to the static stability of the plastic mounting floor 16.

FIG. 8 shows a longitudinal cross section through one half of an upper wall 3 of the mounting floor 16 as an open variant. The insert 32 as a preformed, non-rusting metal sheet 32, especially a stainless steel sheet 32, made from chrome-nickel steel for example, is inserted into the tool during the injection molding of the plastic mounting floor 16 and overmolded. This produces a fluid-tight connection between the insert 32 and the mounting floor 16.

FIG. 9 shows a longitudinal cross section through one half of an upper wall 3 of the mounting floor 16 as an open variant. The insert 32, as a preformed, non-rusting metal sheet 32, especially a stainless steel sheet 32, made from chrome-nickel steel for example, is fixed using gluing points 39 to the mounting floor 16 and at the same time the required fluid seal between the insert 32 and the surface of the plastic part of the washing compartment lower wall 3 is established.

FIG. 10 shows a longitudinal cross section through one half of an upper wall 3 of the mounting floor 16 as an open variant. The insert 32, as a preformed, non-rusting metal sheet 32, especially a stainless steel sheet 32, made from chrome-nickel steel for example, is fixed with the aid of at least one latching element 38 to the mounting floor 16. The latching element 38 can also be arranged at points other than the one depicted in FIG. 10 (not shown). The sealing element 35 looks after the required sealing between the insert 32 and the plastic part of the washing compartment lower wall 3.

In this embodiment, as in all other embodiments or variants described above, instead of an insert 32 made of metal, an insert 32 made of plastic can also be fitted. This means that even with the same tool for injection molding of the mounting floor 16, a washing compartment floor 3 with one visible metal surface, especially a stainless steel surface, and one plastic surface is created. This thus makes possible a platform concept that is suitable both for lower price classes with visible plastic in the floor area of the washing compartment 14 and also for higher price classes with a preferably visible stainless steel surface in the floor area of the washing compartment 14. Furthermore the plastic insert 32 can also be produced in other colors and also with a specific surface structure and thus the surface of the washing compartment 14 can be optically diversified in the floor area. The inserts 32 preferably made of stainless steel can also have a surface structure which differs from that of walls 11, 17, 18, 19, e.g. a honeycomb, circle-pattern (adjoining circles), corrugated or rectangle-pattern surface. This allows the inner chamber of the washing compartment to be further diversified for different price classes, e.g. for premium-class dishwashers as well.

As well as the options shown in the above embodiments in FIG. 1 through 10, all other technical applications can be used to produce a different appearance of the wall 3 of the mounting floor 16. Possible options here for example are the coating, i.e. the application of an adhesive layer made from any given amorphous material to the wall 3 of the mounting floor 16 (e.g. sputtering, chemical processes, coating, lacquering, e.g. painting, spraying, dipping etc.).

Viewed overall, a variable platform concept is made available with the present invention which makes it possible to combine the benefits in the production process of a platform concept from the prior art, in which the plastic mounting floor forms the lower wall of the washing compartment and a separate housing is present, with the aesthetic and thereby marketing-relevant benefits of a washing compartment made entirely from stainless steel. Over and above this the visible surface of the lower wall of the washing compartment can be diversified still further, so that an even greater flexibility for tailoring the dishwasher to different price categories is possible.

The invention claimed is:

1. A dishwasher, comprising:

a tub open at a front and at a bottom and including walls comprising a non-rusting metal; and a mounting floor comprising plastic, the tub and the mounting floor together forming a washing compartment, a lower wall of the washing compartment being formed by the mounting floor in an interior of the washing compartment, the washing compartment lower wall having a different appearance from the plastic of the mounting floor, the lower wall including an exit aperture therein configured to convey liquids to a sump, wherein the lower wall comprises an opening formed therein and an insert covering the opening with a fluid-tight connection.

2. The dishwasher of claim 1, wherein the washing compartment lower wall has a visible surface with a non-rusting metal appearance.

3. The dishwasher of claim 1, wherein a visible surface of the washing compartment lower wall differs in a color than a color of the rest of the mounting floor.

4. The dishwasher of claim 1, wherein a visible surface of the washing compartment lower wall includes a stainless steel foil.

5. The dishwasher of claim 4, wherein the mounting floor is a static self-supporting floor.

6. The dishwasher of claim 1, wherein a visible surface of the washing compartment lower wall includes a stainless steel sheet.

7. The dishwasher of claim 1, wherein a visible surface of the washing compartment lower wall includes a surface of the insert, the insert including a non-rusting metal sheet.

8. The dishwasher of claim 1, further including a seal element to form the fluid-tight connection.

9. The dishwasher of claim 1, wherein a visible surface of the washing compartment lower wall includes a surface of the insert that is sealed from a plastic of the washing compartment lower wall by one of a gluing point, a gluing area, and a gapless back molded connection.

10. The dishwasher of claim 9, wherein the insert is connected to the plastic of the washing compartment lower wall by a latch.

11. The dishwasher of claim 9, wherein an adhesive connects the insert to the plastic of the mounting floor.

12. The dishwasher of claim 1, wherein a visible surface of the washing compartment lower wall includes the insert, the insert including a material other than metal that is a different color from a plastic of the mounting floor.

13. The dishwasher of claim 1, wherein the tub is a non-rusting metal and is not a portion of a plastic housing.

14. The dishwasher of claim 1, further including a housing that is apart from one of the tub and the mounting floor.

15. The dishwasher of claim 14, wherein the housing is an independent component from the tub.

16. The dishwasher of claim 1, wherein the insert has a different appearance from the plastic of the mounting floor.

17. A method for producing a dishwasher, the method comprising:

providing a tub open at a front and at a bottom and including walls comprising a non-rusting metal; and providing a mounting floor comprising a plastic, the tub and the mounting floor together forming a washing compartment, a lower wall of the washing compartment being formed by the mounting floor in an interior of the washing compartment, the washing compartment lower wall having a different appearance from the plastic of the mounting floor, the lower wall including an exit aperture therein configured to convey liquids to a sump, wherein the lower wall comprises an opening formed therein and an insert covering the opening with a fluid-tight connection.

18. The method of claim 17, wherein a visible surface of the washing compartment lower wall includes a material that is different than the plastic of the mounting floor.

19. The method of claim 17, wherein the insert has a different appearance from the plastic of the mounting floor.

20. The method of claim 17, further comprising a seal element to form the fluid-tight connection.

21. The method of claim 17, wherein an adhesive connects the insert to the plastic of the mounting floor.

22. A dishwasher assembly, comprising:

a tub open at a front and at a bottom and including walls comprising a non-rusting metal;

a mounting floor attached to the tub and comprising plastic, the tub and the mounting floor together forming a washing compartment, a lower wall of the washing compartment being formed by the mounting floor in an interior of the washing compartment; and a plurality of insert having different appearances, wherein the washing compartment lower wall includes an opening formed therein for interchangeably accommodating each of the plurality of different inserts in a fluid-tight arrangement to provide the washing compartment lower wall with a plurality of different appearances from the plastic of the mounting floor.

23. The dishwasher assembly of claim 22, further comprising a seal element to form the fluid-tight arrangement.

24. The dishwasher assembly of claim 22, wherein an adhesive connects the inserts to the plastic of the mounting floor.

25. The dishwasher assembly of claim 22, wherein the lower wall includes an exit aperture therein configured to convey liquids to a sump.

* * * * *